US011445578B2

(12) United States Patent
Ok et al.

(10) Patent No.: US 11,445,578 B2
(45) Date of Patent: Sep. 13, 2022

(54) INDUCTION HEATING DEVICE WITH IMPROVED FUNCTION FOR DISTINGUISHING OBJECT

(71) Applicant: LG Electronics Inc., Seoul (KR)

(72) Inventors: Seungbok Ok, Seoul (KR); Wongyu Park, Seoul (KR); Byeong Wook Park, Seoul (KR)

(73) Assignee: LG Electronics Inc., Seoul (KR)

( * ) Notice: Subject to any disclaimer, the term of this patent is extended or adjusted under 35 U.S.C. 154(b) by 418 days.

(21) Appl. No.: 16/598,642

(22) Filed: Oct. 10, 2019

(65) Prior Publication Data

US 2020/0120761 A1 Apr. 16, 2020

(30) Foreign Application Priority Data

Oct. 10, 2018 (KR) ..... 10-2018-0120563

(51) Int. Cl.
*H05B 6/06* (2006.01)
*H05B 6/04* (2006.01)
*H05B 6/12* (2006.01)

(52) U.S. Cl.
CPC ..... *H05B 6/06* (2013.01); *H05B 6/04* (2013.01); *H05B 6/1245* (2013.01); *H05B 2206/022* (2013.01); *H05B 2213/07* (2013.01)

(58) Field of Classification Search
CPC ..... H05B 6/062; H05B 2206/022; H05B 2213/07; H05B 2213/03; H05B 2213/05; H05B 6/06; H05B 6/1218; H05B 6/04; H05B 6/1245; Y02B 40/00
See application file for complete search history.

(56) References Cited

U.S. PATENT DOCUMENTS

2012/0248098 A1* 10/2012 Lee ..... H05B 6/1272 219/660
2015/0114953 A1* 4/2015 Suzuki ..... H05B 6/1254 219/620
2016/0261372 A1 9/2016 Zeng et al.

FOREIGN PATENT DOCUMENTS

DE 112013004163 T5 5/2015
EP 244007 A2 4/2012
JP 2014116088 A 6/2014
(Continued)

OTHER PUBLICATIONS

Extended European Search Report in European Appln. No. 19201932.1, dated Feb. 13, 2020, 5 pages.

*Primary Examiner* — Dana Ross
*Assistant Examiner* — Kuangyue Chen
(74) *Attorney, Agent, or Firm* — Fish & Richardson P.C.

(57) ABSTRACT

An induction heating device includes a case, a working coil, a cover plate, a luminous element, a light guide disposed around the working coil, an input interface that is flush with an upper surface of the cover plate, a first controller configured to control driving of the working coil and the luminous element and to detect a position of one or more objects disposed on the upper surface and an arrangement sequence of the one or more objects placed on the upper surface, and a second controller configured to receive, from the first controller, information on the position and the arrangement sequence of the one or more objects, and control the input interface to display an image corresponding to a heating zone for the one or more objects based on the information on the position and the arrangement sequence of the one or more objects.

20 Claims, 13 Drawing Sheets

(56) References Cited

FOREIGN PATENT DOCUMENTS

| | | | | |
|---|---|---|---|---|
| WO | WO-2014030315 A1 * | 2/2014 | ..... | H05B 6/1218 |
| WO | 2014063539 A1 | 5/2014 | | |

* cited by examiner

INDUCTION HEATING DEVICE WITH IMPROVED FUNCTION FOR DISTINGUISHING OBJECT

CROSS-REFERENCE TO RELATED APPLICATION

The present disclosure claims priority to and the benefit of Korean Patent Application No. 10-2018-0120563, filed on Oct. 10, 2018, the disclosure of which is incorporated herein by reference in its entirety.

TECHNICAL FIELD

The present disclosure relates to an induction heating device with improved function for distinguishing objects.

BACKGROUND

Various types of cooking utensils may be used to heat food in homes and restaurants. For example, gas ranges may use gas as fuel. In some examples, cooking devices may heat an object such as a vessel or a pot with electricity instead of gas.

A method of heating an object via electricity may be classified into a resistive heating method and an induction heating method. In the electrical resistive method, heat may be generated based on current flowing through a metal resistance wire or a non-metallic heating element, such as silicon carbide, and may be transmitted to the object (e.g., a cooking vessel) through radiation or conduction, to heat the object. In the induction heating method, eddy current may be generated in the object made of metal based on a magnetic field generated, around the coil, when a high-frequency power of a predetermined magnitude is applied to the coil to heat the object.

In some cases, an induction heating device that uses the induction heating method may include a working coil in multiple regions of the device to heat the plurality of objects (e.g., cooking vessels).

In some cases, an induction heating device (e.g., a zone-free type induction heating device) may heat a single object using a plurality of working coils simultaneously. The zone-free type induction heating device may heat the object inductively in a zone in which a plurality of working coils are present regardless of a size and a position of the object.

In some examples, the zone-free type induction heating device may include an input interface. For example, the input interface may be a module to input heating intensity or driving time that a user desires, and may be variously implemented with a physical button or a touch panel. In some cases, the input interface may also include a display panel (e.g., a touch screen type panel) in which a driving state of the induction heating device (e.g., an image of a heating zone for the object) may be displayed.

In some cases, the zone-free type induction heating device may detect the object arranged above the plurality of working coils, activate the working coil based on the detected position of the object, and display an image of the heating zone corresponding to the position of the activated working coil on the input interface.

In some examples, when a plurality of objects are placed, the zone-free type induction heating device may independently display images of the heating zones corresponding to objects to be displayed on the input interface.

For instance, the zone-free type induction heating device may distinguish the plurality of objects using a method corresponding to boundary conditions of the working coil (e.g., a method for distinguishing activated working coils using an inactivated working coil placed between the activated working coils).

In some cases, where the method corresponding to the boundary conditions of the working coils is used to distinguish the plurality of objects, the plurality of adjacent objects may be recognized as one object, and thus only one image of a heating zone may be displayed on the input interface.

SUMMARY

The present disclosure provides an induction heating device that performs an improved function for distinguishing objects.

The present disclosure also provides an induction heating device having improved user experience (UX) and user interface (UI).

The objects of the present disclosure are not limited to the above-mentioned objects, and other objects and advantages of the present disclosure which are not mentioned may be understood by the following description and more clearly understood by the implementations of the present disclosure. It will also be readily apparent that the objects and the advantages of the present disclosure may be implemented by features defined in claims and a combination thereof.

According to one aspect of the subject matter described in this application, an induction heating device includes: a case; a working coil disposed inside the case; a cover plate coupled to an upper surface of the case; a luminous element disposed inside the case; a light guide that is disposed in the case around the working coil, that is installed on the luminous element, and that is configured to indicate whether the working coil is driven and an output intensity of the working coil; an input interface that is flush with an upper surface of the cover plate and that is configured to display one or more images; a first controller configured to control driving of the working coil and driving of the luminous element and to detect a position of one or more objects disposed on the upper surface of the cover plate and an arrangement sequence of the one or more objects placed on the upper surface of the cover plate; and a second controller configured to receive, from the first controller, information on the position and the arrangement sequence of the one or more objects, and control the input interface to display an image corresponding to a heating zone for the one or more objects based on the information on the position and the arrangement sequence of the one or more objects.

Implementations according to this aspect may include one or more of the following features. For example, the working coil may include a plurality of working coils, the luminous element may include a plurality of luminous elements, and the one or more objects may include a first object and a second object different from the first object. The information on the position and the arrangement sequence of the one or more objects may include: information on a first working coil among the plurality of working coils that is disposed below the first object and a second working coil among the plurality of working coils that is disposed below the second object; information on whether another working coil among the plurality of working coils is present between the first working coil and the second working coil; information on whether the first object or the second object is placed above an additional working coil among the plurality of working coils other than the first working coil, the second working coil, a working coil between the first working coil and the second working coil; and information on an arrangement sequence of the first object and the second object placed on the upper surface of the cover plate.

In some implementations, the second controller may be configured to: based on a determination that another working coil is present between the first working coil and the second working coil, display (i) a first image representing a first heating zone for the first object in a first area of the input interface corresponding to a first position of the first object on the cover plate and (ii) a second image representing a second heating zone for the second object in a second area of the input interface corresponding to a second position of the second object. The first area is spaced apart from the second area.

In some implementations, the first controller may be configured to: based on a determination that another working coil is present between the first working coil and the second working coil, drive a first luminous element among the plurality of luminous elements that is disposed around the first working coil and a second luminous element among the plurality of luminous elements that is disposed around the second working coil.

In some implementations, the second controller may be configured to: based on at least one of (i) a determination that another working coil is not present between the first working coil and the second working coil, (ii) a lack of the information on the arrangement sequence of the first object and the second object, or (iii) a determination that the first object and the second object are placed on the upper surface of the cover plate at a same time, display, on the input interface, a single image representing a heating zone for both of the first object and the second object. In some examples, the single image may include: a first portion that represents a first heating zone for the first object and that corresponds to a first position of the first object on the cover plate; and a second portion that is adjacent to the first portion, that represents a second heating zone for the second object, and that corresponds to a second position of the second object on the cover plate.

In some implementations, the first controller may be configured to: based on at least one of (i) a determination that another working coil is not present between the first working coil and the second working coil, (ii) a lack of the information on the arrangement sequence of the first object and the second object, or (iii) a determination that the first object and the second object are disposed on the upper surface of the cover plate at a same time, drive a first luminous element among the plurality of luminous elements that is disposed around the first working coil and a second luminous element among the plurality of luminous elements that is disposed around the second working coil, and stop driving of a third luminous element disposed between the first working coil and the second working coil.

In some implementations, the second controller may be configured to: based on (i) a determination that another working coil is not present between the first working coil and the second working coil and (ii) a determination that the first object was placed on the cover plate prior to the second object based on the information on the arrangement sequence of the first object and the second object, display (i) a first image representing a first heating zone for the first object in a first area of the input interface corresponding to a first position of the first object on the cover plate and (ii) a second image representing a second heating zone for the second object in a second area of the input interface corresponding to a second position of the second object. The first area and the second area may be adjacent to each other in the input interface, and the first image and the second image may be independent images displayed in the first area and the second area of the input interface, respectively.

In some implementations, the first controller may be configured to: based on (i) a determination that another working coil is not present between the first working coil and the second working coil and (ii) a determination that the first object was placed on the cover plate prior to the second object based on the information on the arrangement sequence of the first object and the second object, drive a first luminous element among the plurality of luminous elements that is disposed around the first working coil and a second luminous element among the plurality of luminous elements that is disposed around the second working coil.

In some implementations, the input interface may be configured to receive touch input from a user and provide the touch input to the second controller, where the second controller may be configured to control a portion of the one or more images displayed on the input interface based on the touch input received from the input interface, and the first controller may be configured to receive the touch input from the second controller, and control driving of the working coil and driving of the luminous element based on the touch input received from the second controller.

In some implementations, the induction heating device may further include: a base plate that supports the working coil; an indicator substrate disposed vertically below the base plate and spaced apart from the base plate, where the indicator substrate includes the luminous element; a ferrite core that is disposed on the base plate, that is disposed vertically below the working coil, and that is configured to diffuse an alternating magnetic field generated by the working coil; and a mica sheet disposed between the working coil and the ferrite core and configured to restrict heat transfer from the working coil to the ferrite core.

According to another aspect, a method is described for controlling an induction heating device that includes a case, a working coil disposed inside the case, a cover plate coupled to an upper surface of the case, a luminous element disposed inside the case, a light guide installed on the luminous element around the working coil and configured to indicate whether the working coil is driven and an output intensity of the working coil, an input interface that is flush with an upper surface of the cover plate and that may be configured to display one or more images, and one or more controllers configured to control the working coil, the luminous element, and the input interface. The method includes: detecting a position of one or more objects disposed on the upper surface of the cover plate and an arrangement sequence of the one or more objects placed on the upper surface of the cover plate; determining information on the position and the arrangement sequence of the one or more objects; and displaying, on the input interface, an image representing a heating zone for the one or more objects based on the information on the position and the arrangement sequence of the one or more objects.

Implementations according to this aspect may include one or more of the following features or the features described above for the induction heating device. For example, the working coil may include a plurality of working coils, the luminous element may include a plurality of luminous elements, and the one or more objects may include a first object and a second object different from the first object. Determining the information on the position and the arrangement sequence of the one or more objects may include: determining a first position of a first working coil among the plurality of working coils that is disposed below the first object and a second position of a second working coil among the plurality of working coils that is disposed below the second object; determining whether another working coil among the plurality of working coils is present between the first working coil and the second working coil; and determining an arrangement sequence of the first object and the second object placed on the upper surface of the cover plate.

In some implementations, determining the information on the position and the arrangement sequence of the one or more objects further may include: determining whether the first object or the second object is placed above an additional working coil among the plurality of working coils other than the first working coil, the second working coil, and a working coil between the first working coil and the second working coil.

In some implementations, displaying the image representing the heating zone may include: based on a determination that another working coil is present between the first working coil and the second working coil, displaying (i) a first image representing a first heating zone for the first object in a first area of the input interface corresponding to the first position of the first object on the cover plate and (ii) a second image representing a second heating zone for the second object in a second area of the input interface corresponding to the second position of the second object on the cover plate. The first area is spaced apart from the second area.

In some implementations, the method may further include: based on a determination that another working coil is present between the first working coil and the second working coil, driving a first luminous element among the plurality of luminous elements that is disposed around the first working coil and a second luminous element among the plurality of luminous elements that is disposed around the second working coil.

In some implementations, displaying the image representing the heating zone may include: based on at least one of (i) a determination that another working coil is not present between the first working coil and the second working coil, (ii) a lack of the information on the arrangement sequence of the first object and the second object, or (iii) a determination that the first object and the second object are placed on the upper surface of the cover plate at a same time, displaying, on the input interface, a single image representing a heating zone for both of the first object and the second object.

In some implementations, the method may further include: based on at least one of (i) a determination that another working coil is not present between the first working coil and the second working coil, (ii) a lack of the information on the arrangement sequence of the first object and the second object, or (iii) a determination that the first object and the second object are disposed on the upper surface of the cover plate at a same time, driving a first luminous element among the plurality of luminous elements that is disposed around the first working coil and a second luminous element among the plurality of luminous elements that is disposed around the second working coil, and stopping driving of a third luminous element disposed between the first working coil and the second working coil.

In some implementations, displaying the image representing the heating zone may include: based on (i) a determination that another working coil is not present between the first working coil and the second working coil and (ii) a determination that the first object was placed on the cover plate prior to the second object, displaying (i) a first image representing a first heating zone for the first object in a first area of the input interface corresponding to the first position of the first object on the cover plate and (ii) a second image representing a second heating zone for the second object in a second area of the input interface corresponding to the second position of the second object on the cover plate. The first area and the second area are adjacent to each other in the input interface, and the first image and the second image are independent images displayed in the first area and the second area of the input interface, respectively.

In some implementations, the method may further include: based on (i) a determination that another working coil is not present between the first working coil and the second working coil and (ii) a determination that the first object was placed on the cover plate prior to the second object, driving a first luminous element among the plurality of luminous elements that is disposed around the first working coil and a second luminous element among the plurality of luminous elements that is disposed around the second working coil.

The induction heating device may improve the UX and the UI, thereby improving user convenience in various types of situations.

A specific effect of the present disclosure, in addition to the above-mentioned effect, will be described together while describing a specific matter to implement the present disclosure.

DETAILED DESCRIPTION

The above mentioned objects, features, and advantages of the present disclosure will be described in detail with reference to the accompanying drawings, so that those skilled in the art to which the present disclosure pertains may easily implement the technical idea of the present disclosure.

Hereinafter, an induction heating device according to an implementation of the present disclosure will be described.

Figure 1:
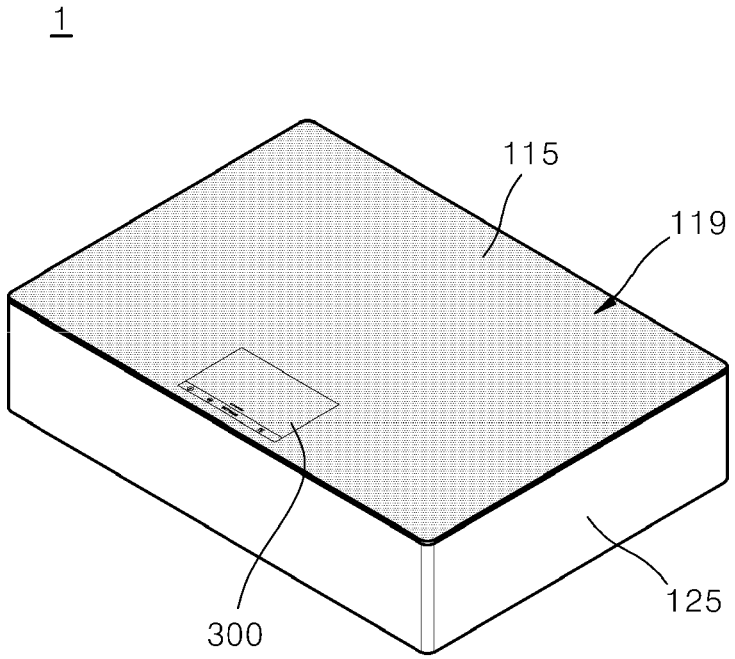
FIG. 1 is a perspective view showing an example of an induction heating device.
Figure 2:
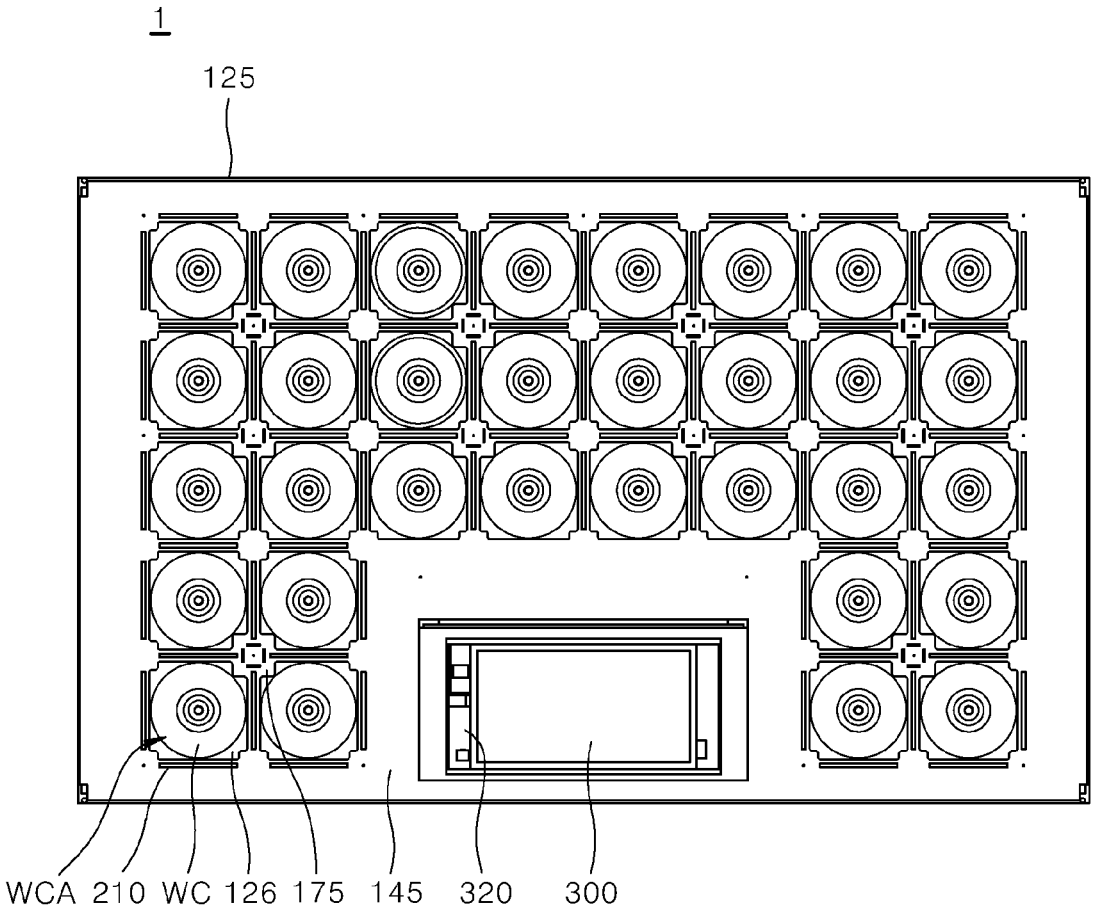
FIG. 2 is a plan view showing example components of the induction heating device in FIG. 1.
Figure 3:
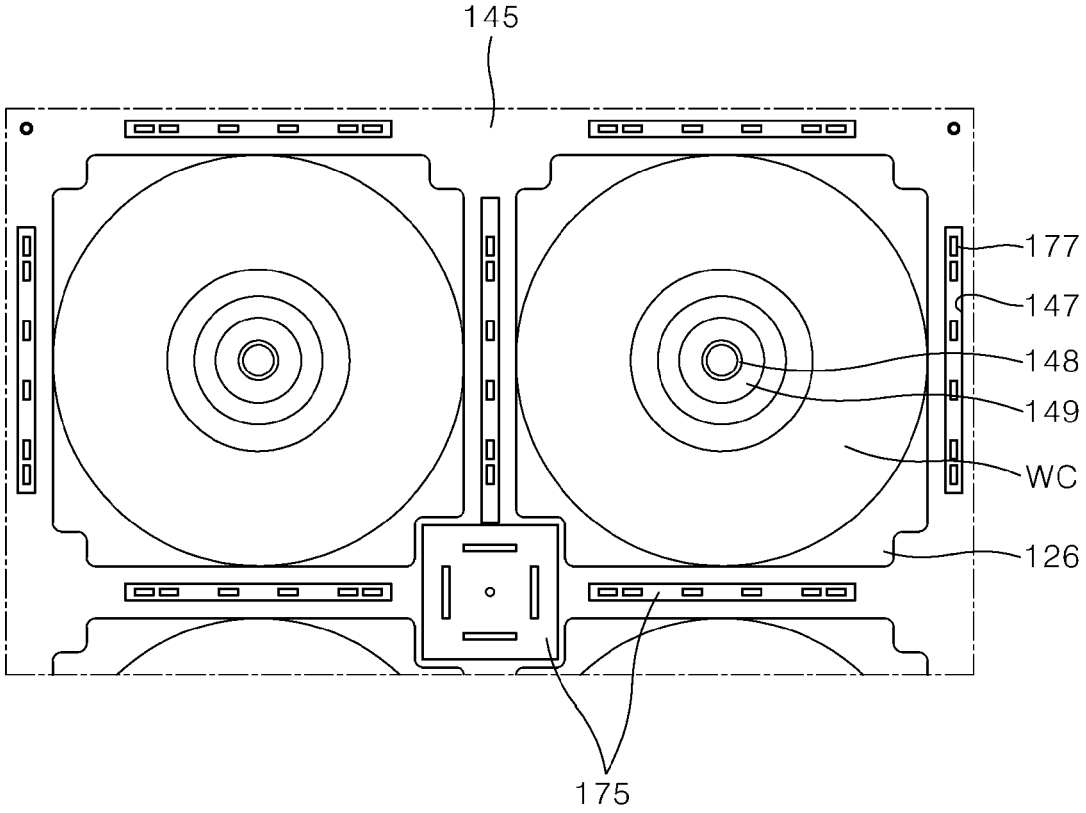
FIGS. 3 and 4 are partially enlarged views showing the induction heating device in FIG. 2.
Figure 4:
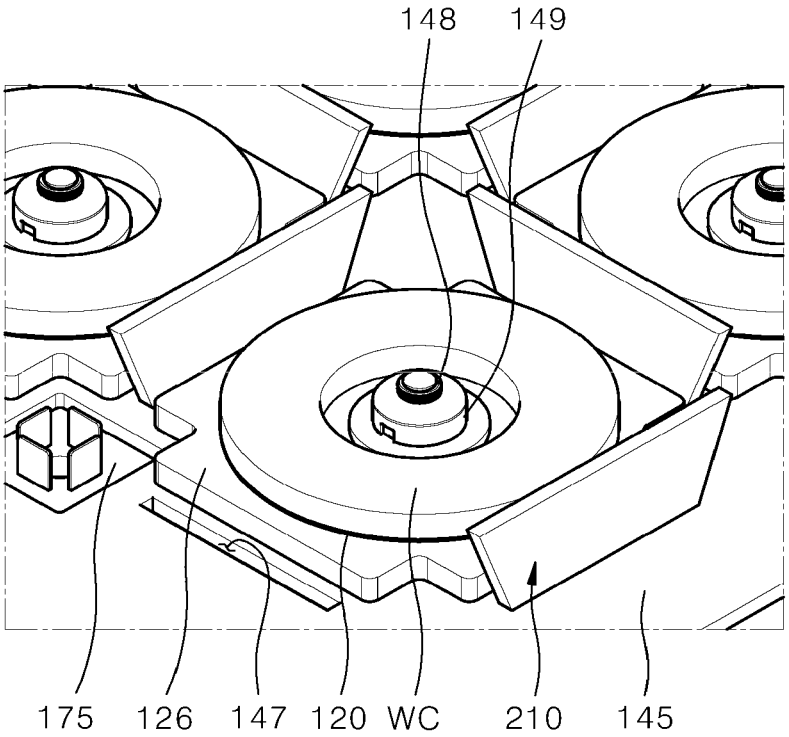
Figure 5:
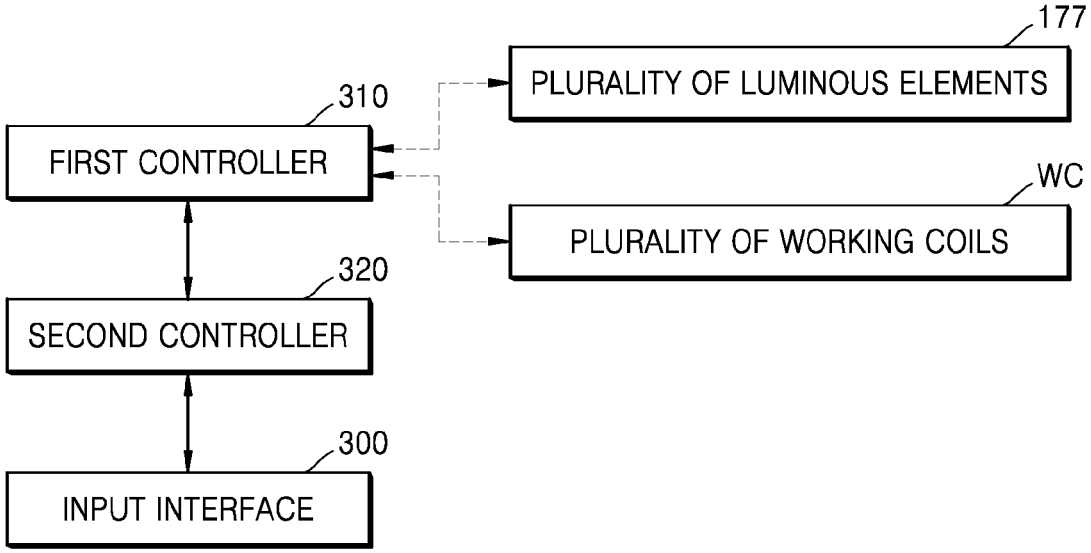
FIG. 5 is a block diagram showing an example of a control flow of the induction heating device in FIG. 1.

FIG. 1 illustrates an example of an induction heating device according to an implementation of the present disclosure. FIG. 2 is a plan view showing the induction heating device with some components omitted from FIG. 1. FIGS. 3 and 4 are partial enlarged views showing the induction heating device in FIG. 2. FIG. 5 is a block diagram showing an example of a control flow of the induction heating device in FIG. 1.

For example, for convenience of explanation, in FIG. 2, a cover plate 119 is omitted from FIG. 1. In FIGS. 4 and 5, some components (e.g., the light guide) of the induction heating device 1 is omitted from FIG. 2.

Referring to FIGS. 1 to 5, the induction heating device 1 may include a case 125, a cover plate 119, a base plate 145, an indicator substrate 175, an indicator (i.e., including a luminous element 177 and a light guide 210), an input interface 300, and a working coil assembly (WCA).

In some implementations, the induction heating device 1 may include various types of components such as, for example, the working coil assembly WCA, the base plate 145, the indicator substrate 175, the luminous element 177, and the light guide 210 that are installed in the case 125. The case 125 may define an inner space configured to receive the various components of the induction heating device 1.

In some implementations, the induction heating device 1 may include various types of devices related to driving of the working coil WC (e.g., a power supply that provides alternating current (AC) power, a rectifier that rectifies the AC power of the power to a direct current (DC) power, an inverter that coverts the DC power rectified by the rectifier into resonant current through switching operation and provides the working coil WC with the converted resonant current, a first controller 310 that controls the inverter and components related to the driving of the inverter, and a relay or a semiconductor switch that turns on or turns off the working coil WC) installed in the case 125.

In some implementations, the case 125 may be thermally insulated to prevent a heat generated by the working coil WC from being leaking to the outside.

The cover plate 119 may be coupled to an upper surface of the case 125 to close the inside of the case 125, and the object may be disposed on an upper surface of the cover plate 119.

Specifically, the cover plate 119 may include a top plate 115 to place an object such as a cooking vessel thereon, and the heat generated by the working coil WC may be transferred to the object through the top plate 115.

The top plate 115 may be made of, for example, glass, and the input interface 300 that receives the touch input from the user and transmits the touch input to the second controller 320 may be installed in the top plate 115.

The input interface 300 may be flatly buried in the upper surface of the cover plate 119, that is, the top plate 115 (i.e., flatly installed on the same plane as the top plate 115) and may display one or more images (e.g., an image of a heating zone, an image of residual heat, an image of heating intensity, and the like). For example, the input interface 300 may be flush with the upper surface of the cover plate 119. The input interface 300 may also receive the touch input from the user and provide the second controller 320 with the received touch input.

In some examples, the input interface 300 may be or include a module to input heating intensity or heating time, and the like, the user desires and may be variously implemented with a physical button or a touch panel. The input interface 300 may also include a display panel on which a driving state of the induction heating device 1 is displayed. For example, the input interface 300 may include a touch screen-type panel.

In some implementations, the input interface 300 may transmit the touch input received from the user to the second controller 320. The second controller 320 may transmit the touch input to the above-mentioned first controller 310. Details thereof are described below.

In some examples, the working coil assembly WCA may include a working coil WC, a ferrite core 126, and a mica sheet 120 (e.g., a first mica sheet).

In some implementations, when the induction heating device 1 is a zone-free type induction heating device, a plurality of working coil assemblies WCAs may be present as shown in FIG. 2, and the plurality of working coil assemblies (e.g., WCAs) may be spaced apart from one another by a predetermined distance.

However, for convenience of explanation, one working coil assembly WCA is described.

In some examples, the working coil WC may include an annularly-wound conductive wire with a plurality of times and may generate an AC magnetic field. The driving of the working coil WC may also be controlled by the first controller 310 and the mica sheet 120 and the ferrite core 126 may be sequentially arranged beneath or below the working coil WC.

The ferrite core 126 may be arranged below the working coil WC and a core hole may be provided at a central region of the ferrite core 126 to vertically overlap with an annular inner side of the working coil WC.

Specifically, a base plate 145 may be arranged below the ferrite core 126, and a mica sheet 120 may be arranged between the ferrite core 126 and the working coil Wc.

Further, as shown in FIGS. 3 and 4, a packing gasket 149 is fastened to the core hole so that the ferrite core 126 may be fixed to the base plate 145, and a sensor 148 may be installed at an upper end of the packing gasket 149. In some implementations, the sensor 148 may detect a temperature of the top plate 115, a temperature of the working coil WC or an operation of the working coil WC and may transmit the temperature information or the operation information, and the like, to the above-mentioned first controller 310 or the second controller 320.

Further, the ferrite core 126 may be fixed to the mica sheet 120 through a sealant, and may diffuse the AC magnetic field generated by the working coil WC.

The mica sheet 120 (e.g., a first mica sheet) may be arranged between the working coil WC and the ferrite core 126 and a sheet hole may be provided at the central portion of the mica sheet 120 to vertically overlap with the annular inner side of the working coil WC.

Specifically, the mica sheet 120 may be fixed to the working coil WC and the ferrite core 126 by the sealant, and may prevent the heat generated by the working coil WC from being directly transferred to the ferrite core 126.

In some implementations, the induction heating device 1 may further include a second mica sheet that is fixed to an upper end of the working coil WC by the sealant and the second sheet hole is provided at a central region of the second mica sheet to vertically overlap with the annular inner side of the working coil WC.

As described above, the working coil assembly (WCA) may be provided.

The working coil assembly WCA is installed in the base plate 145.

Specifically, the ferrite core 126, the mica sheet 120, and the working coil WC may be sequentially stacked on or above the base plate 145. Further, an indicator substrate 175 may be arranged below the base plate 145 to be spaced apart from the base plate 145.

Further, the base plate 145 may be formed integrally, for example, and may be made of aluminum (Al), but is not limited thereto.

Further, the light guide 210 may be installed in the base plate 145.

Specifically, the light guide 210 may be installed in the base plate 145 and disposed around the working coil WC. For example, four light guides 210 per one working coil WC may be installed around the working coil WC.

The light guide 210 displays the light emitted from the luminous element 177 through an upper light emitting surface (i.e., an upper surface) to display whether the working coil WC is driven and the output intensity of the working coil WC (i.e., heating power). Further, each light guide 210 may be installed in each light guide installation hole 147 provided in the base plate 145.

As shown in FIGS. 3 and 4, the light guide installation hole 147 to install the light guide 210 may be provided on the base plate 145 in the space between the ferrite cores. That is, the light guide installation hole 147 may be provided on the base plate 145 at the position in which the light guide 210 is installed. Therefore, the light guide installation hole 147 may also be provided around the working coil WC, and four light guide installation holes (e.g., 147) per one working coil WC may be provided around the working coil WC.

Further, the number of the light guide installation holes 147 may be the same as the light guides 210.

In some implementations, the light emitted from the luminous element 177 installed on the indicator substrate 175 may be transmitted to the light guide 210 through the light guide installation hole 147. Accordingly, the light guide 210 may display whether the working coil WC is driven and the output intensity of the working coil WC.

The indicator substrate 175 may be arranged below the base plate 145 to be spaced apart from the base plate 145 and the luminous element 177 may be installed on the indicator substrate 175.

Specifically, the indicator substrate 175 may be installed on an indicator substrate support so that the indicator substrate 175 is spaced downward from the base plate 145.

Further, as shown in FIG. 3, a plurality of luminous elements may be provided and the plurality of luminous elements (e.g., 177) may be installed on the indicator substrate 175 to be exposed upward through the light guide installation hole (e.g., 147). Thus, the light emitted from the luminous element 177 may be transmitted to the light guide 210 through the light guide installation hole 147.

The plurality of luminous elements (e.g., 177) may include, for example, light emitting diodes (LEDs), respectively.

Further, an example of the indicator substrate 175 may include a printed circuit substrate (i.e., PCB) and may drive the plurality of luminous elements (e.g., 177) based on a control signal received from the first controller 310. Further, in some implementations, various types of components may be further installed in the indicator substrate 175 to drive the plurality of luminous elements (e.g., 177).

In some implementations, the first controller 310 controls the driving of the plurality of working coils (e.g., WC) and the plurality of luminous elements (e.g., 177) and may detect the position and an arrangement sequence of objects disposed on the upper surface of the cover plate 119.

Further, the first controller 310 may provide the second controller 320 with information on the detected position and arrangement sequence of the objects, and may receive, from the second controller 320, the touch input of the user.

In some implementations, the first controller 310 may control driving of at least one of the plurality of working coils (e.g., WCs) and driving of at least one of the plurality of luminous elements (e.g., 177) based on the touch input of the user received from the second controller 320.

The second controller 320 receives, from the first controller 310, the information on the position and the arrangement sequence of the objects, and may control the input interface 300 so that the image of the heating zone for the object is displayed on the input interface 300 based on the received information on the position and the arrangement sequence of the object.

Specifically, the second controller 320 may control the driving of the input interface 300. That is, the input interface 300 may display a specific image according to the control command of the second controller 320.

In some implementations, the second controller 320 may receive, from the input interface 300, the touch input of the user and may transmit the received touch input to the first controller 310, or may control or select a portion of an image (e.g., an image of residual heat, a timer image, an image of heating intensity, and the like), among the specific images displayed on the input interface 300 based on the received touch input.

Further, the second controller 320 may receive, from the first controller 310, the information on the position and the arrangement sequence of the object and may control the image of the heating zone for the object displayed on the input interface 300 based on the received information on the position and the arrangement sequence of the object.

In some implementations, the case 125 may further include various types of components included in the induction heating device 1, for example, an indicator substrate support on which the indicator substrate is installed, a blowing fan that cools heat generated by the plurality of working coils (e.g., WC) or the plurality of luminous elements (e.g., 177).

In some implementations, according to an implementation of the present disclosure, the induction heating device 1 may perform a function for transferring wireless power based on the above-mentioned configuration and feature.

That is, power is wirelessly supplied and is applied to a plurality of electronic devices. Electronic devices that use a technology for transmitting wireless power are charged by simply placing the electronic devices on a charging pad without connecting the electronic device to an additional charge connector. The electronic devices that transmit the wireless power may not require a wired cord or a charger, thereby improving portability of the electronic devices and reducing a size and a weight of the electronic devices.

The technology for transmitting the wireless power may use an electromagnetic induction method using a coil, a resonance method using resonance, and a radio wave radiation method in which electrical energy is converted into a microwave and the converted microwave is transmitted. The electromagnetic induction method uses electromagnetic induction between a primary coil (e.g., a working coil WC) provided in a device that transmits wireless power and a secondary coil provided in a device that receives wireless power to transmit the power.

In some implementations, the induction heating method of the induction heating device 1 substantially has the same principle as the technology for transmitting the wireless power using electromagnetic induction in that the object is heated by electromagnetic induction.

In some implementations, the induction heating device 1 may perform a function for transmitting the wireless power, as well as performing a function of induction heating. Further, an induction heating mode or a wireless power transmission mode may be controlled by the first controller 310 or the second controller 320. Thus, the function for inductively heating the object or the function for transmitting the wireless power may be selectively performed as necessary.

As described above, the induction heating device 1 according to the implementation of the present disclosure has the above-described configuration and features, and hereinafter, a method for distinguishing objects and displaying information on positions of objects, by the induction heating device 1, is described.

Figure 6:
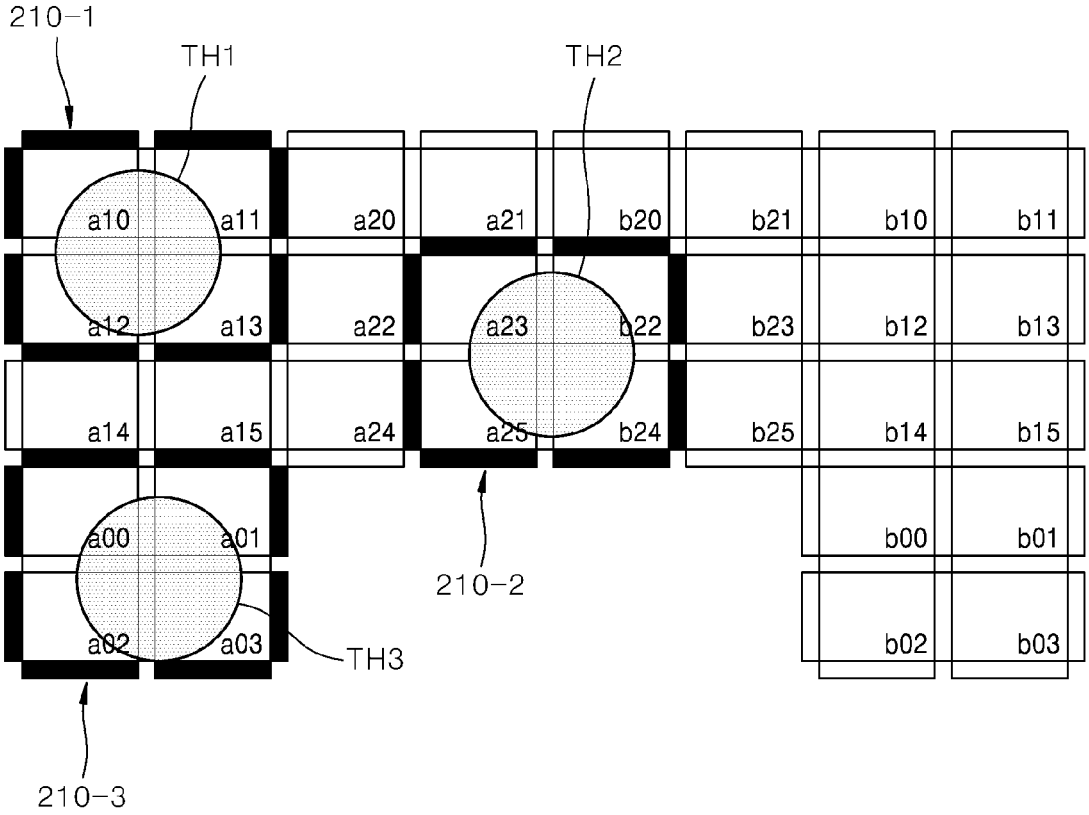
FIGS. 6 and 7 are schematic views showing example methods for distinguishing objects and displaying information on positions of objects, by the induction heating device in FIG. 1.
Figure 7:
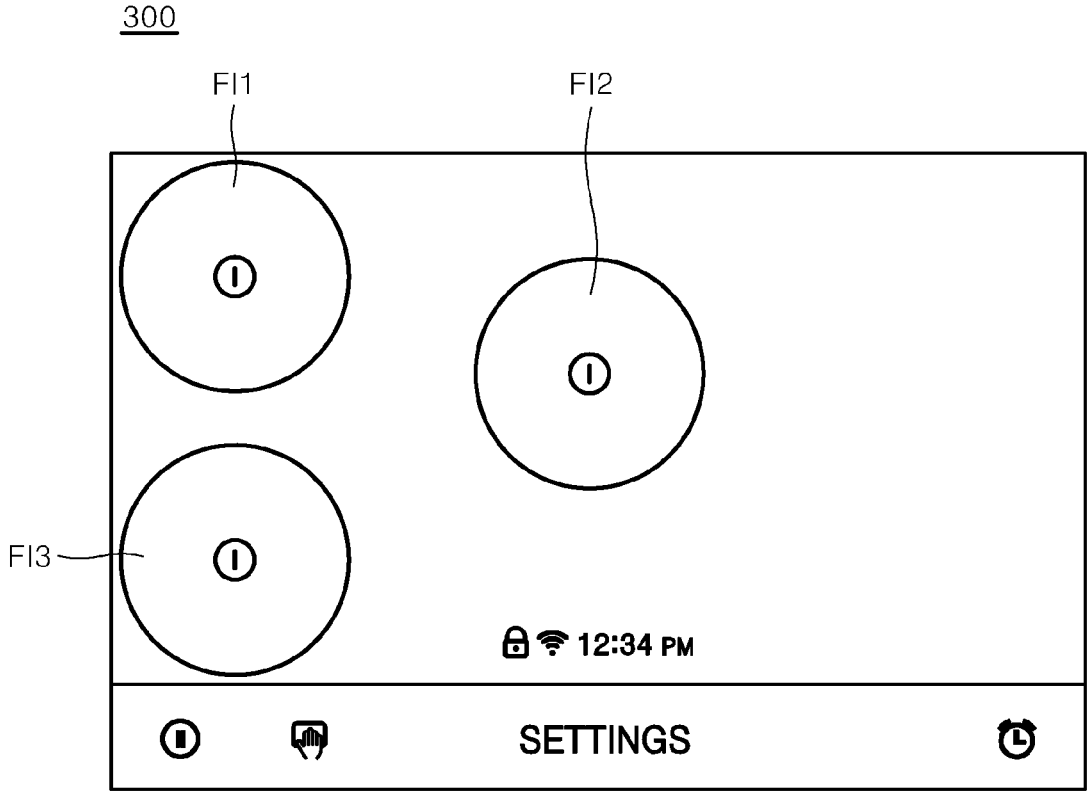
Figure 8:
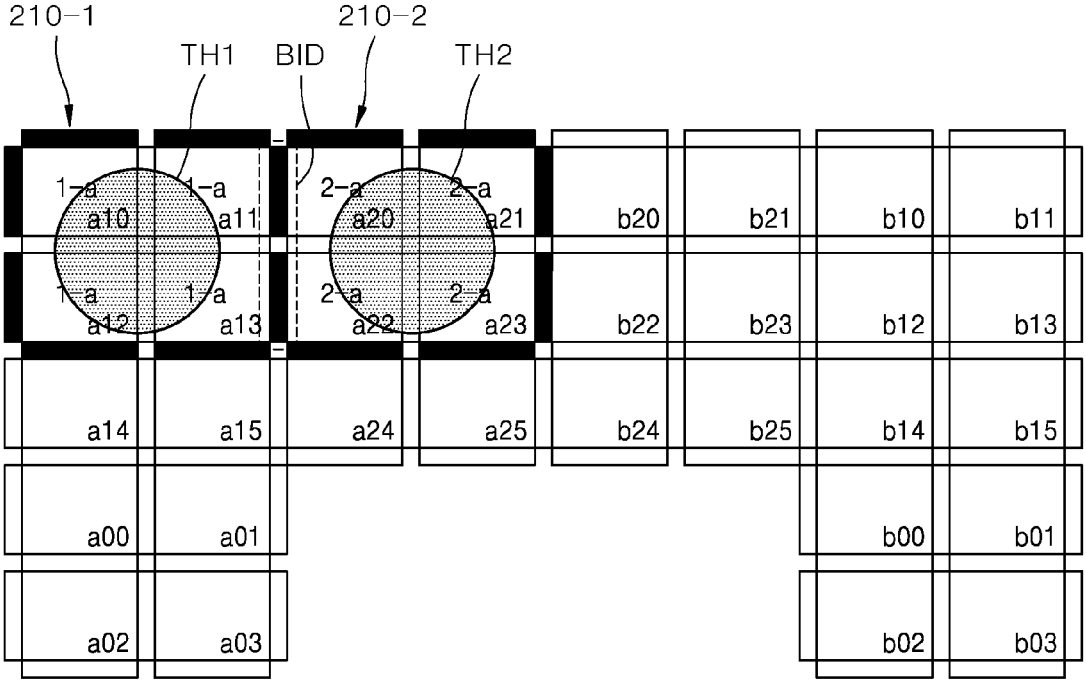
FIGS. 8 and 9 are schematic diagrams showing another example of a method for distinguishing objects and displaying information on positions of objects, by the induction heating device in FIG. 1.
Figure 9:
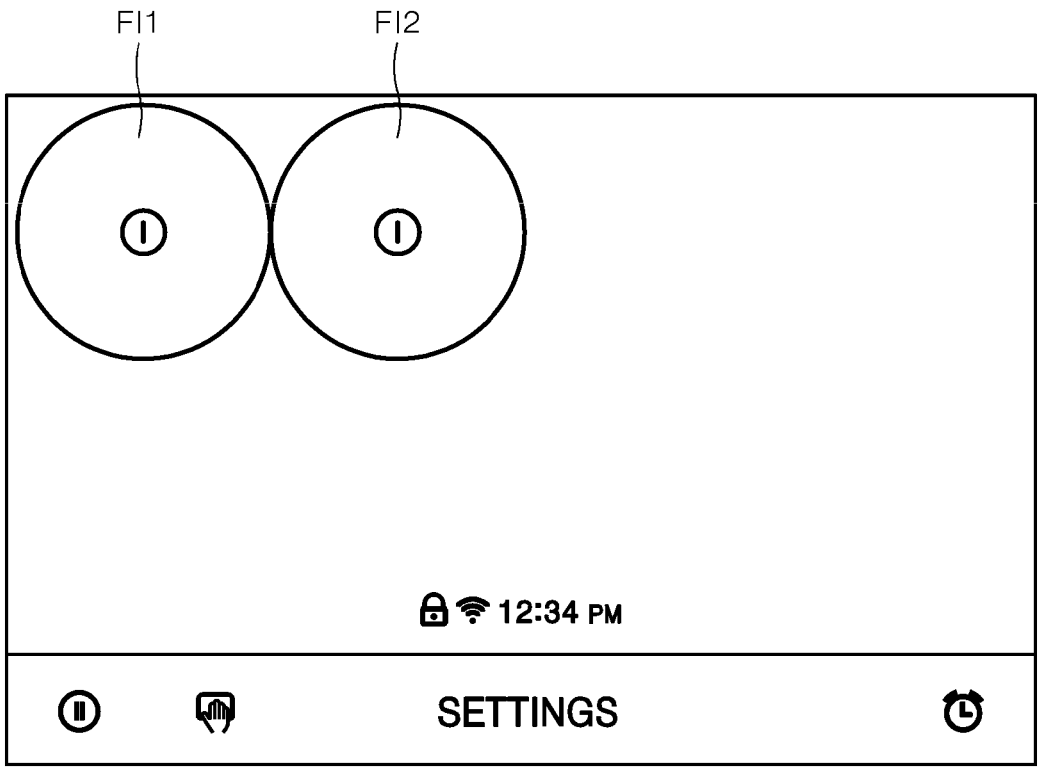
Figure 10:
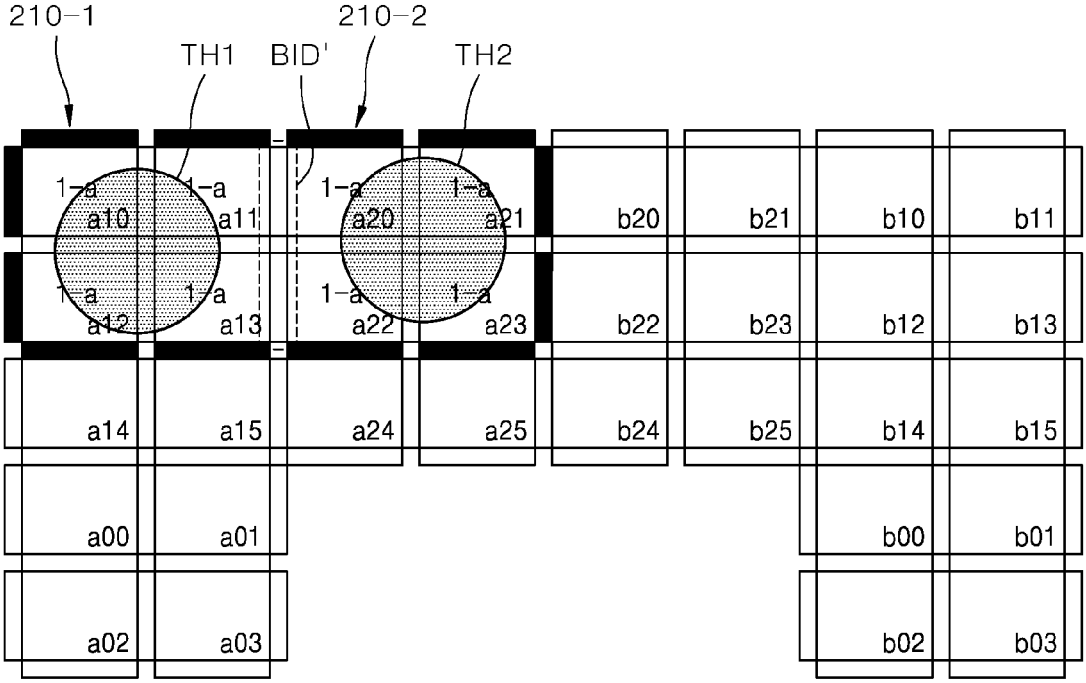
FIGS. 10 and 11 are schematic views showing another example of a method for distinguishing objects and displaying information on positions of objects, by the induction heating device in FIG. 1.
Figure 11:
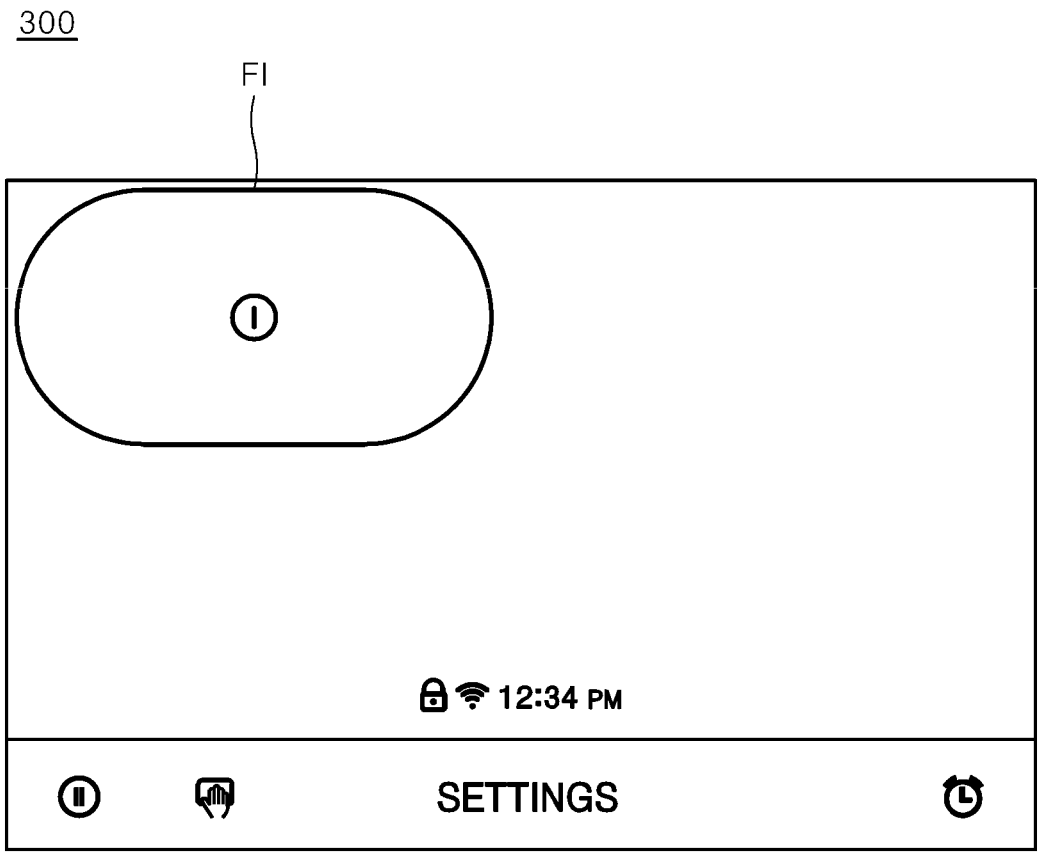
Figure 12:
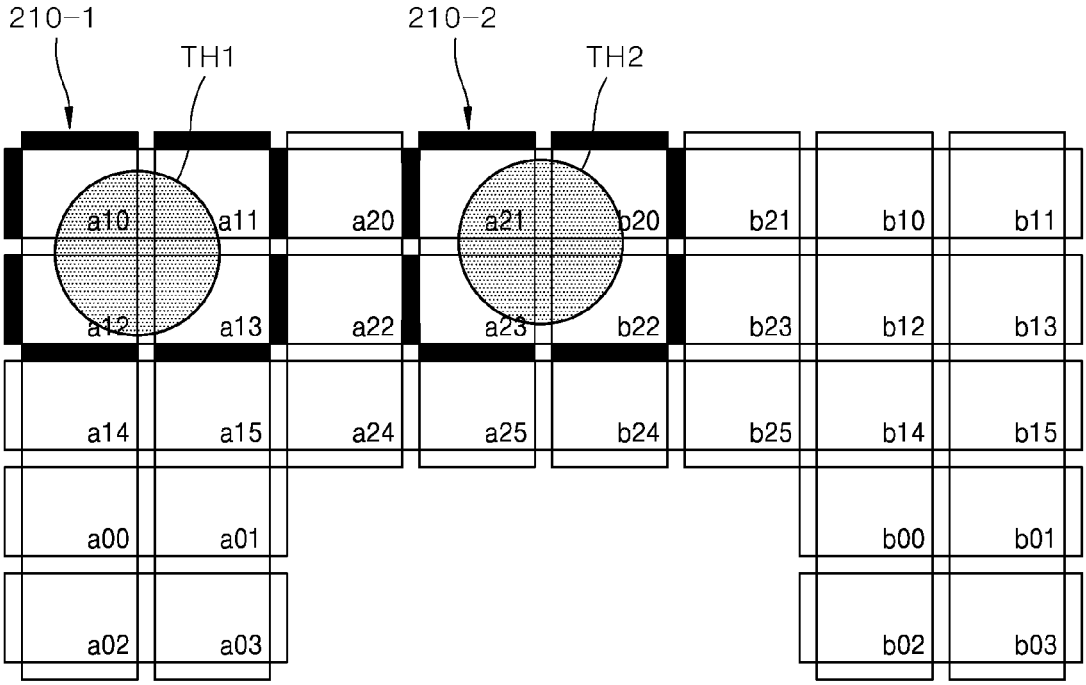
FIGS. 12 and 13 are schematic diagrams showing examples of a user guide in a state in which objects are distinguished and information on positions of the objects, by the induction heating device in FIG. 1.
Figure 13:
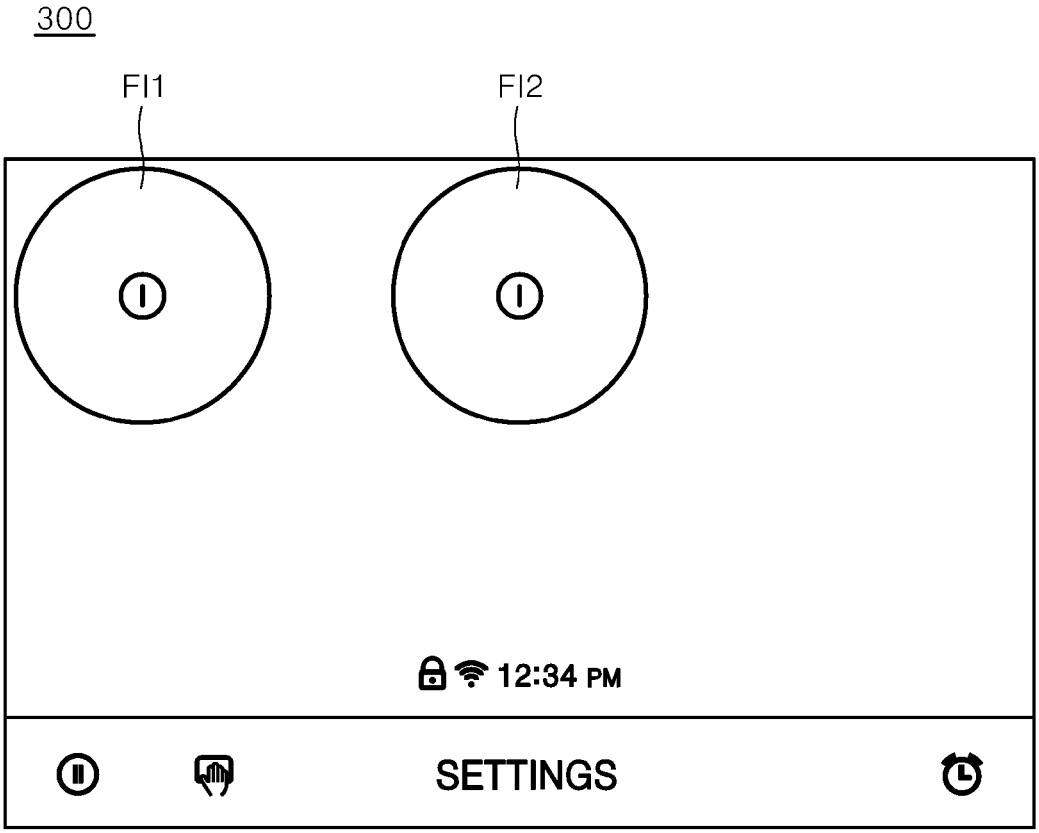

FIGS. 6 and 7 are schematic views showing example methods for distinguishing objects and displaying information on positions of objects, by the induction heating device in FIG. 1. FIGS. 8 and 9 are schematic views showing examples of a method for distinguishing objects and displaying information on positions of objects, by the induction heating device in FIG. 1. FIGS. 10 and 11 are schematic views showing still another example of a method for distinguishing objects and displaying information on positions of objects, by the induction heating device in FIG. 1. FIGS. 12 and 13 are schematic views showing an example of a user guide based on a state in which objects shown in FIGS. 10 and 11 are distinguished and information on positions of objects is displayed.

FIGS. 6, 8, 10, and 12 respectively show light being emitted at light emitting surfaces of light guides disposed around the working coils based on positions of objects. FIGS. 7, 9, 11, and 13 are schematic views of input interfaces when images of heating zones for objects are displayed based on positions of objects.

FIGS. 5 to 7 show example methods for distinguishing objects and displaying information on positions of objects, by the induction heating device 1 in FIG. 1.

Specifically, when an object is arranged on a top plate 115 (see FIG. 1) of a cover plate 119 (see FIG. 1), the first controller 310 may identify information on the position and the arrangement sequence of the objects (i.e., an order in which objects are placed on the top plate 115 in FIG. 1). For example, a first object may be placed on the top plate 115 before or after a second object is placed on the top plate 115. In some cases, the first object and the second object may be placed at the same time on the top plate 115. In some cases, the first object and the second object may be parts of a same object.

A first controller 310 may detect a degree of attenuation of the resonance current flowing through each working coil, and may detect which of working coils the object is placed above based on a result of detection.

In more detail, when the object is placed above the working coil (e.g., WC in FIG. 2), an overall resistance of the object may increase due to a resistance of the object, thereby increasing the degree of attenuation of the resonant current flowing through the working coil (e.g., WC in FIG. 2).

The first controller 310 detects the resonance current flowing through the working coil (e.g., WC in FIG. 2) and detects whether an object is placed above the working coil (e.g., WC in FIG. 2) based on the detected value.

In some implementations, the first controller 310 may detect the object through other methods. In an implementation of the present disclosure, the detection of the object through the above-mentioned method is described.

When the position and arrangement sequence of the objects are detected through the above method, the first controller 310 may provide the second controller 320 with information on the detected position and arrangement sequence of the objects. Further, the second controller 320 may control the input interface 300 to display the image of the heating zone for the object on the input interface 300 based on the received information on the position and arrangement sequence of the objects.

In some implementations, as shown in FIG. 6, when the object includes the first object to third object TH1, TH2, and TH3 different from one another, the information on the position of the object may include information on which working coil the first object TH1 to the third object TH3 placed above, among a plurality of working coils, information on whether another working coil is present between the working coils placed below the first object TH1 to the third object TH3, and information on whether the object is placed above another working coil. Further, the information on the arrangement sequence of the object may include information on the arrangement sequence of the first object TH1 to the third object TH3.

Specifically, as shown in FIG. 6, when another working coil is present between the working coils placed below the first object TH1 to the third object TH3, the information on the position of the object may include information regarding the first object TH1 placed above the working coils corresponding to "a10 to a13" and the second object TH2 placed above the working coils corresponding to "a23, a25, b22, and b24", and the third object TH3 placed above the working coils corresponding to "a00 to a03", and information regarding another working coils (e.g., a14, a15, a20, a22, and 24) provided between working coils placed below first object TH1 to the third object TH3.

As shown in FIG. 6, when another working coil is present between working coils placed below the first object TH1 to the third object TH3, the second controller 320 may accurately display the image of the heating zone corresponding to each of the first object TH1 to the third object TH3 without information on the arrangement sequence of the object.

That is, when different working coils are present between the working coils placed below the first object TH1 to the third object TH3, the induction heating device 1 is powered when the first object TH1 to the third object TH3 are disposed on the upper surface of the cover plate (119 in FIG. 1), or the first object TH1 to the third object TH3 are placed on the upper surface of the cover plate (119 in FIG. 1) at the same time, the second controller 320 may accurately display the image of the heating zone corresponding to each of the first object TH1 to the third object TH3 based on the information on the position of each of the first object TH1 to the third object TH3.

In some implementations, when the induction heating device 1 is powered when the first object TH1 to the third object TH3 are disposed on the upper surface of the cover plate 119 in FIG. 1, or the first object TH1 to the third object TH3 are disposed on the upper surface of the cover plate 119 in FIG. 1, the information on the arrangement sequence of the object may include information regarding the first object TH1 to the third object TH3 having the same arrangement sequence.

Accordingly, as shown in FIG. 6, the first controller 310 may drive the luminous element disposed around the working coil placed below each of the first object TH1 to the third object TH3, among the plurality of luminous elements, so that the light may be emitted at the light emitting surface of light guides 210-1, 210-2, and 210-3 disposed above the luminous element.

Further, as shown in FIG. 7, an image of a heating zone for an object FI1 may be displayed in a first area of the input interface 300 so that the image of the heating zone of the object FI1 corresponds to the position of the first object TH1 placed on the cover plate 119 in FIG. 1. An image of a heating zone for a second object FI2 may be displayed in a second area of the input interface 300 so that the image of the heating zone for the second object FI2 corresponds to the position of the second object TH2. Further, an image FI3 of a heating zone for a third object may be displayed in a third area of the input interface 300 so that the image FI3 of the heating zone for the third object corresponds to the position of the third object TH3, The first area may be spaced apart from the third area.

Next, FIGS. 8 and 9 show another example of a method for distinguishing objects and displaying information on positions of objects, by the induction heating device 1 in FIG. 1.

Specifically, as shown in FIG. 8, no other working coil is present between the working coils placed below the first object TH1 and the second object TH2, and the first object TH1 has the arrangement sequence faster than that of the second object TH2, the information on the position of the object may include information regarding the first object TH1 placed above working coils corresponding to "a10 to a13", and the second object TH2 placed above the working coils corresponding to "a20 to a23", and another working coil being not present between working coils placed below the first object TH1 and the second object TH2.

Further, the information on the arrangement sequence of the object may include information on the arrangement sequence of the first object TH1 (1-a; i.e., the object is placed in area "a" first) being faster than the arrangement sequence of the second object TH2 (2-a; i.e., the object is placed in the area "a" secondarily).

Accordingly, as shown in FIG. 8, the first controller 310 may drive the luminous element placed around the working coil placed below each of the first object TH1 and the second object TH2 among the plurality of luminous elements, so that the light may be emitted at the light emitting surface of the light guides 210-1 and 210-2 placed above the luminous element.

The luminous element placed between the working coil provided below the first object TH1 and the working coil provided below the second object TH2 is also driven, so that the light may be emitted at the light emitting surface of a light guide BID placed above the luminous element.

Further, as shown in FIG. 9, the image FI1 of the heating zone for the first object may be displayed in a first area of the input interface 300 so that the image FI1 of the heating zone for the first object corresponds to the position of the first object TH1 placed on the cover plate (119 in FIG. 1). The image FI2 of the heating zone for the second object may be displayed in the second area of the input interface 300 so that the image FI2 of the heating zone for the second object corresponds to the position of the second object TH2 placed on the cover plate 119 in FIG. 1.

The image FI1 of the heating zone for the first object and the image FI2 of the heating zone for the second object are independent of each other and may be displayed on the input interface 300. The first area may be adjacent to the second area.

In some implementations, FIGS. 10 and 11 respectively show still another example of a method for distinguishing objects and displaying information on positions of objects, by the induction heating device 1 in FIG. 1.

Specifically, as shown in FIG. 10, another working coil is not present between the working coils placed below the first object TH1 and the second object TH2, and the information on the arrangement sequence of each of the first object TH1 and the second object TH2 is not provided or the first object TH1 and the second object TH2 are placed on the upper surface of the cover plate 119 in FIG. 1 at the same time, the information on the position of the object may include information on one object being placed above the working coils corresponding to "a10 to a13, and a20 to a23".

Further, the information on the arrangement sequence of the objects may include information on the arrangement sequence of a single object (1-a; i.e., the object is placed in the area "a" first).

Accordingly, as shown in FIG. 10, the first controller 310 may drive the luminous element placed around the working coil disposed below each of the first object TH1 and the second object TH2, among the plurality of luminous elements, and may stop the driving of the luminous element placed between the working coil disposed below the first object TH1 and the working coil disposed below the second object TH2.

As shown in FIG. 10, the light may not be emitted at the light emitting surface of a portion of light guide BID", among light guides 210-1 and 210-2 disposed around the first object TH1 and the second object TH2.

Further, as shown in FIG. 11, the image of the heating zone for the first object and the image of the heating zone for the second object may be displayed on the input interface 300 as a single image FI of the heating zone so that the image of the heating zone for the first object and the image of the heating zone for the second object may correspond to the position of the first object and the position of the second object placed on the cover plate 119 in FIG. 1.

The single image may represent an overall heating zone that covers both of the first object and the second object. For example, the single image may include a first portion (e.g., the left portion of FI) that represents a first heating zone for the first object and that corresponds to a first position of the first object on the cover plate, and a second portion (e.g., the right portion of FI) that is adjacent to the first portion, that represents a second heating zone for the second object, and that corresponds to a second position of the second object on the cover plate.

In FIGS. 10 and 11, the first object and the second object may not be suitably distinguished, but the user may know that the first object and the second object are recognized as one object through the light emitting surface of the light guide.

Accordingly, the user may move any one of the first object and the second object, thereby resolving a problem that the first object and the second object are recognized as one object.

That is, FIGS. 12 and 13 show examples of user guide by distinguishing objects and displaying information on positions of objects shown in FIGS. 10 and 11.

Specifically, as shown in FIG. 12, when the user changes the position of the second object TH2 from "a20 to a23" to "a21, a23, b20, and b22", the information on the position of the object may include information on the first object TH1 being placed above the working coils corresponding to "a10 to a13" and the second object TH2 being placed above the working coils corresponding to "a21, a23, b20, and b22", and information on other working coils a20 and a22 being present between working coils placed below the first object TH1 and the second object TH2.

The second controller 320 may accurately display the image of the heating zone corresponding to the each of the first object TH1 and the second object TH2 without information on the arrangement sequence of the objects.

When the second object TH2 is placed at new positions a21, a23, b20, and b22 after the second object TH2 deviates from a previous position (i.e., a20 to a23 in FIG. 10), the information on the arrangement sequence of the object may include information on the arrangement sequence of the first object TH1 being faster than the arrangement sequence of the second object TH2.

Accordingly, as shown in FIG. 12, the first controller 310 may drive the luminous element placed around the working coil disposed below each of the first object TH1 and the second object TH2, among the plurality of luminous elements, so that the light may be emitted at the light emitting surface of the light guides 210-1 and 210-2 disposed above the luminous element.

Further, as shown in FIG. 13, the image FI1 of the heating zone for the first object may be displayed in the first area of the input interface 300 so that the image of the heating zone for the first object FI1 corresponds to the position of the first object TH1 placed on the cover plate 119 in FIG. 1. The image of the heating zone for the second object FI2 may be displayed in the second area of the input interface 300 so that the image of the heating zone for the second object FI2 corresponds to the position of the second object TH2 placed on the cover plate 119 in FIG. 1. The first area may be spaced apart from the second area.

As described above, according to an implementation of the present disclosure, the induction heating device 1 may distinguish the plurality of adjacent objects by performing the improved function for distinguishing objects. Further, the indicator including the luminous element and the light guide compensate the function for distinguishing objects, thereby improving the user convenience and satisfaction.

Further, according to an implementation of the present disclosure, the induction heating device 1 may improve a user experience (UX) and a user interface (UI), thereby improving user convenience in various types of situations.

As various substitutions, changes, and modifications can be made within the scope that does not deviate from the technical idea of the present disclosure for the skilled person in the art to which the present disclosure pertains, the above-mentioned present disclosure is not limited to the above-mentioned implementations and accompanying drawings.

What is claimed is:

1. An induction heating device, comprising:

a case;

a working coil disposed inside the case;

a cover plate coupled to an upper surface of the case;

a luminous element disposed inside the case;

a light guide that is disposed in the case around the working coil and that is installed on the luminous element, the light guide being configured to indicate whether the working coil is driven and an output intensity of the working coil;

an input interface that is flush with an upper surface of the cover plate and that is configured to display one or more images;

a first controller configured to control driving of the working coil and driving of the luminous element and to detect a position of one object or positions of objects disposed on the upper surface of the cover plate and an arrangement sequence of the objects placed on the upper surface of the cover plate; and a second controller configured to receive, from the first controller, information on the position or positions and the arrangement sequence of the objects, and control the input interface to display an image corresponding to a heating zone for the one object or heating zones for the objects based on the information on the position or positions and the arrangement sequence of the objects, wherein the luminous element comprises a plurality of luminous elements, and the objects comprise a first object and a second object different from the first object, and wherein the working coil comprises a plurality of working coils comprising a first working coil disposed below the first object, a second working coil disposed below the second object, and a third working coil different from the first working coil and the second working coil, wherein the information on the position or positions and the arrangement sequence of the objects comprises:

information on the first working coil and the second working coil, information on whether the third working coil is present between the first working coil and the second working coil, information on whether the first object or the second object is placed above the third working coil other than the first working coil and the second working coil, and information on the arrangement sequence of the first object and the second object placed on the upper surface of the cover plate.

2. The induction heating device of claim 1, wherein the information on and the arrangement sequence of the objects comprises a first time point at which the first object is placed on a first area of the upper surface of the cover plate, and a second time point at which the second object is placed on a second area of the upper surface of the cover plate.

3. The induction heating device of claim 1, wherein the heating zones comprise a first heating zone for the first object and a second heating zone for the second object, wherein the second controller is configured to:

based on a determination that the third working coil is present between the first working coil and the second working coil, display (i) a first image representing the first heating zone in a first area of the input interface corresponding to a first position of the first object on the cover plate and (ii) a second image representing the second heating zone in a second area of the input interface corresponding to a second position of the second object, and wherein the first area is spaced apart from the second area.

4. The induction heating device of claim 1, wherein the first controller is configured to:

based on a determination that the third working coil is present between the first working coil and the second working coil, drive a first luminous element among the plurality of luminous elements that is disposed around the first working coil and a second luminous element among the plurality of luminous elements that is disposed around the second working coil.

5. The induction heating device of claim 1, wherein the second controller is configured to:

based on (i) a determination that the third working coil is not present between the first working coil and the second working coil, and at least one of (ii) a lack of the information on the arrangement sequence of the first object and the second object, and (iii) a determination that the first object and the second object are placed on the upper surface of the cover plate at a same time, display, on the input interface, a single image representing a heating zone for both of the first object and the second object.

6. The induction heating device of claim 5, wherein the heating zones comprise a first heating zone for the first object and a second heating zone for the second object, and wherein the single image comprises:

a first portion that represents the first heating zone and corresponds to a first position of the first object on the cover plate; and a second portion that is adjacent to the first portion, that represents the second heating zone, and that corresponds to a second position of the second object on the cover plate.

7. The induction heating device of claim 1, wherein the first controller is configured to:

based on (i) a determination that the third working coil is not present between the first working coil and the second working coil, and at least one of (ii) a lack of the information on the arrangement sequence of the first object and the second object, and (iii) a determination that the first object and the second object are disposed on the upper surface of the cover plate at a same time, drive a first luminous element among the plurality of luminous elements that is disposed around the first working coil and a second luminous element among the plurality of luminous elements that is disposed around the second working coil, and stop driving of a third luminous element disposed between the first working coil and the second working coil.

8. The induction heating device of claim 1, wherein the heating zones comprise a first heating zone for the first object and a second heating zone for the second object, wherein the second controller is configured to:

based on (i) a determination that the third working coil is not present between the first working coil and the second working coil and (ii) a determination that the first object was placed on the cover plate prior to the second object based on the information on the arrangement sequence of the first object and the second object, display (i) a first image representing the first heating zone in a first area of the input interface corresponding to a first position of the first object on the cover plate and (ii) a second image representing the second heating zone in a second area of the input interface corresponding to a second position of the second object, wherein the first area and the second area are adjacent to each other in the input interface, and wherein the first image and the second image are independent images displayed in the first area and the second area of the input interface, respectively.

9. The induction heating device of claim 1, wherein the first controller is configured to:

based on (i) a determination that the third working coil is not present between the first working coil and the second working coil and (ii) a determination that the first object was placed on the cover plate prior to the second object based on the information on the arrangement sequence of the first object and the second object, drive a first luminous element among the plurality of luminous elements that is disposed around the first working coil and a second luminous element among the plurality of luminous elements that is disposed around the second working coil.

10. The induction heating device of claim 1, wherein the input interface is configured to receive touch input from a user and provide the touch input to the second controller, wherein the second controller is configured to control a portion of the one or more images displayed on the input interface based on the touch input received from the input interface, and wherein the first controller is configured to receive the touch input from the second controller, and control driving of the working coil and driving of the luminous element based on the touch input received from the second controller.

11. The induction heating device of claim 1, further comprising:

a base plate that supports the working coil;

an indicator substrate disposed vertically below the base plate and spaced apart from the base plate, the indicator substrate comprising the luminous element;

a ferrite core that is disposed on the base plate, that is disposed vertically below the working coil, and that is configured to diffuse an alternating magnetic field generated by the working coil; and a mica sheet disposed between the working coil and the ferrite core and configured to restrict heat transfer from the working coil to the ferrite core.

12. A method for controlling an induction heating device, the induction heating device including a case, a working coil disposed inside the case, a cover plate coupled to an upper surface of the case, a luminous element disposed inside the case, a light guide installed on the luminous element around the working coil and configured to indicate whether the working coil is driven and an output intensity of the working coil, an input interface that is flush with an upper surface of the cover plate and that is configured to display one or more images, and one or more controllers configured to control the working coil, the luminous element, and the input interface, the method comprising:

detecting a position of one object or positions of objects disposed on the upper surface of the cover plate and an arrangement sequence of the objects placed on the upper surface of the cover plate;

determining information on the position or positions and the arrangement sequence of the objects; and displaying, on the input interface, an image representing a heating zone for the one object or the objects based on the information on the position or positions and the arrangement sequence of the objects, wherein the luminous element comprises a plurality of luminous elements, and the objects comprise a first object and a second object different from the first object, and wherein the working coil comprises a plurality of working coils comprising a first working coil disposed below the first object, a second working coil disposed below the second object, and a third working coil different from the first working coil and the second working coil, and wherein determining the information on the position or positions and the arrangement sequence of the objects comprises:

determining a first position of the first working coil among the plurality of working coils and a second position of the second working coil among the plurality of working coils, determining whether the third working coil is present between the first working coil and the second working coil, and determining the arrangement sequence of the first object and the second object placed on the upper surface of the cover plate.

13. The method of claim 12, wherein determining the arrangement sequence of the first object and the second object comprises:

determining a first time point at which the first object is placed on a first area of the upper surface of the cover plate; and determining a second time point at which the second object is placed on a second area of the upper surface of the cover plate.

14. The method of claim 12, wherein determining the information on the position or positions and the arrangement sequence of the objects further comprises:

determining whether the first object or the second object is placed above the third working coil among the plurality of working coils other than the first working coil, the second working coil.

15. The method of claim 12, wherein displaying the image representing the heating zone comprises:

based on a determination that the third working coil is present between the first working coil and the second working coil, displaying (i) a first image representing a first heating zone for the first object in a first area of the input interface corresponding to the first position of the first object on the cover plate and (ii) a second image representing a second heating zone for the second object in a second area of the input interface corresponding to the second position of the second object on the cover plate, wherein the first area is spaced apart from the second area.

16. The method of claim 12, further comprising:

based on a determination that the third working coil is present between the first working coil and the second working coil, driving a first luminous element among the plurality of luminous elements that is disposed around the first working coil and a second luminous element among the plurality of luminous elements that is disposed around the second working coil.

17. The method of claim 12, wherein displaying the image representing the heating zone comprises:

based on (i) a determination that the third working coil is not present between the first working coil and the second working coil, and at least one of (ii) a lack of the information on the arrangement sequence of the first object and the second object, and (iii) a determination that the first object and the second object are placed on the upper surface of the cover plate at a same time, displaying, on the input interface, a single image representing a single heating zone for both of the first object and the second object.

18. The method of claim 12, further comprising:

based on (i) a determination that the third working coil is not present between the first working coil and the second working coil, and at least one of (ii) a lack of the information on the arrangement sequence of the first object and the second object, and (iii) a determination that the first object and the second object are disposed on the upper surface of the cover plate at a same time, driving a first luminous element among the plurality of luminous elements that is disposed around the first working coil and a second luminous element among the plurality of luminous elements that is disposed around the second working coil, and stopping driving of a third luminous element disposed between the first working coil and the second working coil.

19. The method of claim 12, wherein displaying the image representing the heating zone comprises:

based on (i) a determination that the third working coil is not present between the first working coil and the second working coil and (ii) a determination that the first object was placed on the cover plate prior to the second object, displaying (i) a first image representing a first heating zone for the first object in a first area of the input interface corresponding to the first position of the first object on the cover plate and (ii) a second image representing a second heating zone for the second object in a second area of the input interface corresponding to the second position of the second object on the cover plate, wherein the first area and the second area are adjacent to each other in the input interface, and wherein the first image and the second image are independent images displayed in the first area and the second area of the input interface, respectively.

20. The method of claim 12, further comprising:

based on (i) a determination that the third working coil is not present between the first working coil and the second working coil and (ii) a determination that the first object was placed on the cover plate prior to the second object, driving a first luminous element among the plurality of luminous elements that is disposed around the first working coil and a second luminous element among the plurality of luminous elements that is disposed around the second working coil.

* * * * *